US006111523A

United States Patent [19]

Mee

[11] Patent Number: 6,111,523

[45] **Date of Patent: *Aug. 29, 2000**

[54] METHOD AND APPARATUS FOR PHOTOGRAPHING TRAFFIC IN AN INTERSECTION

[75] Inventor: Gary L. Mee, Houston, Tex.

[73] Assignee: American Traffic Systems, Inc., Scottsdale, Ariz.

[ * ] Notice: This patent issued on a continued prosecution application filed under 37 CFR 1.53(d), and is subject to the twenty year patent term provisions of 35 U.S.C. 154(a)(2).

[21] Appl. No.: 08/561,077

[22] Filed: Nov. 20, 1995

[51] Int. Cl.[7] ..... G08G 1/054

[52] U.S. Cl. ..... 340/937; 340/936; 340/938; 340/941; 348/149; 701/119

[58] Field of Search ..... 340/936, 937, 340/938, 933, 941; 348/149; 701/119

[56] References Cited

U.S. PATENT DOCUMENTS

| | | | |
|---|---|---|---|
| 2,015,612 | 9/1935 | Adler | 177/337 |
| 2,129,602 | 9/1938 | Adler | 177/329 |
| 2,355,607 | 8/1944 | Shepherd | 177/337 |
| 2,419,099 | 4/1947 | Wall | 234/29.5 |
| 2,871,088 | 1/1959 | Abell | 346/1 |
| 2,927,836 | 3/1960 | Shore | 340/937 |
| 3,044,043 | 7/1962 | Wendt | 340/32 |

(List continued on next page.)

FOREIGN PATENT DOCUMENTS

| | | | |
|---|---|---|---|
| 1290428 | 10/1991 | Canada | G08G 1/54 |
| 1316583 | 4/1993 | Canada | G08G 1/54 |
| 1334031 | 1/1995 | Canada | G08G 1/54 |
| 067905A1 | 12/1982 | European Pat. Off. | G08G 1/10 |
| 188694A2 | 7/1986 | European Pat. Off. | G08G 1/10 |
| 0513628A2 | 11/1992 | European Pat. Off. | G08G 1/052 |
| 2208154 | 11/1973 | France | G08G 1/10 |

(List continued on next page.)

OTHER PUBLICATIONS

Michael Lamm, "Smile! You Just Got A Ticket," Popular Mechanics Dec., 1969, pp. 73–76.

Philips Intersection Controller Type 86 AD/82, Philips Telecommunication Review, vol. 33, No. 1, Mar. 1975.

John Gosch, "Europe Gets 'Thinking' Traffic Lights," Electronics, May 1, 1975, pp. 70–71.

"Orbis III—A New Concept in Traffic Surveillance," LTV Aerospace Corporation, Dallas, Texas 1975.

(List continued on next page.)

*Primary Examiner*—Daniel J. Wu

*Attorney, Agent, or Firm*—Thomason, Moser & Patterson, L.L.P.

[57] ABSTRACT

An apparatus of the invention includes a device for triggering a camera to photograph a vehicle within a traffic intersection, where the triggering of the camera is dependent on the speed of the vehicle before entering the intersection and may also be dependent on presence information. The device includes a sensor system (or "sensor array") to transmit signals corresponding to a moving vehicle and a control system for processing the signals and triggering the camera. The signals preferably include "position signals" from which a transit time can be calculated, and "presence signals," from which presence information can be obtained, particularly the location of the rear of the vehicle or the location of the rear wheels of the vehicle. A trigger time for taking a picture of the vehicle may be calculated from the transit time. A method of the invention includes the step of transmitting signals to a control system in response to the vehicle passing over a first traffic sensor and corresponding to the speed of the vehicle. The method may also include the steps of transmitting presence signals to the control system, preferably corresponding to the presence of the vehicle in a known presence zone outside the intersection, and photographing the vehicle in response to those signals. The system preferably uses a first set of signals (reflecting vehicle speed or transit time) and a second set of signals (reflecting the presence of the vehicle) to determine when to trigger the photograph of the vehicle in the intersection zone.

22 Claims, 7 Drawing Sheets

U.S. PATENT DOCUMENTS 3,060,434 10/1962 Biedermann et al. ..... 346/107
3,088,388 5/1963 Tredopp ..... 95/31
3,122,740 2/1964 Kruse ..... 343/8
3,148,015 9/1964 Weaver ..... 346/107
3,165,373 1/1965 Scott ..... 346/107
3,182,288 5/1965 Smith ..... 340/34
3,195,126 7/1965 Barker ..... 343/7
3,206,748 9/1965 Miller ..... 343/8
3,243,806 3/1966 Handschin ..... 343/8
3,382,785 5/1968 Melhart ..... 95/53
3,438,031 4/1969 Fathauer ..... 343/8
3,522,611 8/1970 Maronde ..... 346/107
3,554,102 1/1971 Maronde ..... 95/1.1
3,573,724 4/1971 Komorida ..... 340/38
3,579,236 5/1971 Piechocki ..... 343/8
3,581,647 6/1971 Maronde ..... 95/53 E
3,603,227 9/1971 Maronde et al. ..... 95/1.1
3,604,330 9/1971 Baierbrunn et al. ..... 95/53
3,618,084 11/1971 Balsiger ..... 343/7 A
3,626,413 12/1971 Zachmann ..... 343/8
3,680,043 7/1972 Angeloni ..... 340/33
3,696,369 10/1972 Laymon et al. ..... 340/258
3,699,583 10/1972 Beguin ..... 343/756
3,754,253 8/1973 Balsiger ..... 343/7 ED
3,795,002 2/1974 Nemit ..... 343/754
3,798,655 3/1974 Meek et al. ..... 343/756
3,816,841 6/1974 Maronde et al. ..... 95/10 CD
3,833,762 9/1974 Gudmundsen ..... 178/7.1
3,833,906 9/1974 Augustine ..... 343/784
3,833,909 9/1974 Schaufelberger ..... 343/754
3,849,784 11/1974 Holzapfel ..... 346/107 VP
3,858,223 12/1974 Holzapfel ..... 340/937
3,859,660 1/1975 Augustine et al. ..... 343/8
3,866,165 2/1975 Maronde et al. ..... 340/31 C
3,913,085 10/1975 Farstad ..... 340/261
3,930,735 1/1976 Kerr ..... 356/167
3,952,311 4/1976 Lapeyre ..... 354/5
3,982,255 9/1976 Orlando ..... 354/70
4,051,499 9/1977 Kondo ..... 354/234
4,053,909 10/1977 Shinoda et al. ..... 354/105
4,085,434 4/1978 Stevens ..... 361/413
4,112,424 9/1978 Lapeyre ..... 340/336
4,152,729 5/1979 Hobbs et al. ..... 358/222
4,157,218 6/1979 Gordon et al. ..... 354/66
4,168,894 9/1979 Adolph ..... 354/105
4,173,010 10/1979 Hoffman ..... 340/937
4,192,595 3/1980 Wakazono et al. ..... 354/133
4,200,871 4/1980 Roeder et al. ..... 343/7.4
4,229,726 10/1980 Deaton et al. ..... 340/38 R
4,236,140 11/1980 Aker et al. ..... 343/8
4,245,254 1/1981 Svensson et al. ..... 358/222
4,257,029 3/1981 Stevens ..... 340/40
4,258,430 3/1981 Tyburski ..... 364/900
4,303,945 12/1981 Fawcett et al. ..... 358/222
4,322,828 3/1982 Hoff et al. ..... 367/118
4,335,383 6/1982 Berry ..... 343/8
4,337,528 6/1982 Clinard et al. ..... 367/136
4,344,685 8/1982 Milatz et al. ..... 354/173
4,353,632 10/1982 Saito et al. ..... 354/133
4,362,373 12/1982 Kazami et al. ..... 354/234
4,386,862 6/1983 Kittel et al. ..... 400/144.2
4,408,533 10/1983 Owen et al. ..... 102/211
4,408,857 10/1983 Frank ..... 354/234
4,444,479 4/1984 Johnson et al. ..... 354/413
4,479,704 10/1984 Masunaga ..... 354/137
4,500,868 2/1985 Tokitsu et al. ..... 340/52 F
4,505,559 3/1985 Prinz ..... 354/66
4,527,877 7/1985 Kurosu et al. ..... 354/234.1
4,527,894 7/1985 Goede et al. ..... 356/28
4,591,823 5/1986 Horvat ..... 340/53
4,600,283 7/1986 Görsch et al. ..... 354/66
4,616,911 10/1986 Zeth et al. ..... 354/66
4,634,254 1/1987 Ogihara et al. ..... 354/403
4,644,368 2/1987 Mutz ..... 346/33
4,645,343 2/1987 Stockdale et al. ..... 356/326
4,654,876 3/1987 Atkins ..... 382/54
4,660,050 4/1987 Phillips ..... 343/753
4,661,849 4/1987 Hinman ..... 358/136
4,664,494 5/1987 Hughes et al. ..... 354/234.1
4,707,735 11/1987 Busby ..... 358/108
4,717,915 1/1988 Goede ..... 342/66
4,743,971 5/1988 Hügli ..... 358/213.26
4,747,155 5/1988 Dotson ..... 382/42
4,761,666 8/1988 Goto ..... 354/133
4,764,781 8/1988 Leib et al. ..... 354/65
4,788,553 11/1988 Phillips ..... 343/786
4,789,904 12/1988 Peterson ..... 358/310
4,796,090 1/1989 Fraier ..... 358/211
4,796,109 1/1989 Sordello et al. ..... 360/45
4,799,112 1/1989 Bremmer et al. ..... 360/31
4,803,710 2/1989 Elabd ..... 377/60
4,809,030 2/1989 Takagi et al. ..... 354/414
4,814,629 3/1989 Arnold ..... 250/578
4,847,772 7/1989 Michalopoulos et al. ..... 364/436
4,866,438 9/1989 Knisch ..... 340/937
4,884,072 11/1989 Horsch ..... 340/937
4,887,080 12/1989 Gross ..... 340/937
4,890,129 12/1989 Mody ..... 354/234.1
4,902,889 2/1990 Sodi ..... 250/222.1
4,908,705 3/1990 Wright ..... 358/109
4,922,339 5/1990 Stout et al. ..... 358/108
4,942,415 7/1990 Felle et al. ..... 354/234.1
4,949,186 8/1990 Peterson ..... 358/335
4,952,809 8/1990 McEwen ..... 250/342
4,973,996 11/1990 Harvey ..... 354/106
4,973,997 11/1990 Harvey ..... 354/105
4,984,003 1/1991 Matsumoto et al. ..... 354/235.1
4,988,994 1/1991 Loeven ..... 340/936
4,996,546 2/1991 Pagano et al. ..... 354/76
5,005,042 4/1991 Sato et al. ..... 354/412
5,041,828 8/1991 Loeven ..... 340/937
5,066,950 11/1991 Schweitzer et al. ..... 340/937
5,082,365 1/1992 Kuzmick et al. ..... 356/28
5,093,682 3/1992 Hicks ..... 355/1
5,107,250 4/1992 Pykett ..... 340/566
5,128,702 7/1992 Ogawa et al. ..... 354/106
5,155,597 10/1992 Lareau et al. ..... 358/213.24
5,177,691 1/1993 Welles et al. ..... 364/485
5,202,692 4/1993 Huguenin et al. ..... 342/179
5,218,397 6/1993 Takagi ..... 354/415
5,221,956 6/1993 Patterson et al. ..... 356/28
5,224,075 6/1993 Iino et al. ..... 367/91
5,239,296 8/1993 Jenkins ..... 340/936
5,239,336 8/1993 Matsui et al. ..... 354/416
5,250,946 10/1993 Stanzcyk ..... 340/936
5,257,056 10/1993 Kazumi ..... 354/234.1
5,264,896 11/1993 Lee et al. ..... 354/234
5,278,555 1/1994 Hoekman ..... 340/941
5,291,237 3/1994 Tagami et al. ..... 354/413
5,315,306 5/1994 Doughty et al. ..... 342/192
5,325,142 6/1994 Depatie et al. ..... 354/234.1
5,345,243 9/1994 Levis ..... 342/173
5,389,989 2/1995 Hawkins et al. ..... 354/106
5,432,547 7/1995 Toyama ..... 348/149
5,515,042 5/1996 Nelson ..... 340/937
5,525,996 6/1996 Aker et al. ..... 342/104
5,528,245 6/1996 Aker et al. ..... 342/104
B1 3,952,311 3/1990 Lapeyre ..... 354/5

FOREIGN PATENT DOCUMENTS 2201510 4/1974 France ..... G08G 1/100
2549263 1/1985 France ..... G08G 1/09

| | | | |
|---|---|---|---|
| 2549625 | 1/1985 | France | G08G 1/015 |
| 683658 | 11/1939 | Germany | 43/42 A |
| 1078797 | 3/1960 | Germany | G07C 42/20 |
| 225077 | 5/1962 | Germany | 74/3 D |
| 1172066 | 6/1964 | Germany . | |
| 1597378 | 4/1970 | Germany . | |
| 1574126 | 10/1971 | Germany | G08G 1/10 |
| 2211462B2 | 3/1973 | Germany | G08G 1/10 |
| 2307217 | 12/1974 | Germany | G08G 1/10 |
| 2356909A1 | 5/1975 | Germany | G08G 1/10 |
| 2365331 | 2/1976 | Germany | G08G 1/10 |
| 2802448C2 | 7/1979 | Germany | G03B 15/05 |
| 2817846A1 | 10/1979 | Germany | G03B 11/28 |
| 3034161A1 | 4/1982 | Germany | G03B 17/24 |
| 3220434A1 | 12/1983 | Germany | G01D 1/18 |
| 3306040A1 | 8/1984 | Germany | G01S 13/91 |
| 3327706A1 | 2/1985 | Germany | G08G 1/10 |
| 3535588A1 | 4/1987 | Germany | G03B 15/00 |
| 4214595 | 11/1993 | Germany | G01P 21/100 |
| 49-13730 | 6/1974 | Japan . | |
| 6-243387 | 9/1994 | Japan . | |
| 414210 | 12/1966 | Sweden . | |
| 470674 | 5/1969 | Switzerland | G01S 9/44 |
| 945693 | 1/1964 | United Kingdom . | |
| 1480981 | 7/1977 | United Kingdom | G03B 1/22 |
| 1494945 | 12/1977 | United Kingdom | G06M 3/06 |
| WO86/01615 | 3/1986 | WIPO | G03B 17/24 |
| WO94/28527 | 5/1994 | WIPO . | |

OTHER PUBLICATIONS

"Mobile Orbis III Speed Enforcement Demonstration Project in Arlington, Texas," Final Report, vol. I—Program Evaluation, National Highway Traffic Safety Administration, Department of Transportation, Contract No. DOT–HS–346–3–692, Jun. 30, 1976.

John Hewer, "High Technology Instrument Foils Hasty,"—*Canadian Electronics Engineering*, Aug. 1979, pp. 28–31.

"Multafot—Fully Automatic Red Light Surveillance System," Zellweger Uster Ltd., Uster, Switzerland, 1979.

Glanz et al., "Technology for use in 'Automated' Speed Enforcement," DOT HS–805 545, Midwest Research Institute, Kansas City, Missouri, Interim Report, Jun. 1980.

Werner Kullic, Traffipax–Microspeed–Ein neues, supermodernes Radargerät für die Geschwindigkeitsüberwachung—(Traffipax–Microspeed—a new highly modern radar apparatus for speed monitoring), Polizei, Verker und Technik: Fachzeitschrift für Verkehrs–und Polizeitechnik, Jan. 1982, pp. 49–53.

"Philosphy of application and benefit of the radar speed meters manufactured by Zellweger Uster Ltd.," Zellweger Uster, Ltd., Uster, Switzerland (Apr. 1983).

Blackburn et al., "Pilot Tests of Automated Speed Enforcement Devices and Procedures," DOT HS–806 573, Midwest Research Institute, Kansas City, Missouri, Final Report, Feb. 1984.

"Zellweger Uster Traffic Electronics Multanova®—Radar 6F Photo–exposure type–radar equipment with integrated allocation of measured value," Brochure No. E/10.85/2500, Zellweger Uster Ltd., Uster, Switzerland, 1984.

Claus–H. Lührs, "Geschwindigkeitmessung im Strassenverkehr," Forschungsbericht MA–3, Vorträge des 65. PTB–Seminars, Braunschweig, Feb., 1986. (Talks given during the 65th PTB seminar on traffic speed measurements, edited by Claus–H. Lyhrs, Federal Institute for the Standardization of Physical Measures).

Dickerson, "Speeders Will Get Photo Finish," The Friendswood Weekend Journal, May 30, 1986.

"New Device to Trap Speeders," Dun's Business Month, Jun. 1986.

"LM Man Sells Photo–Radar," The LaMarque Times, Jul. 9, 1986.

"La Marque Utilizing Photographic Radar to Catch Speeders," Houston Chronicle, No star edition, Section 1, p. 25, Oct. 24, 1986.

Mark Toohey, "Pioneering Photo Radar/Area Police Try New Technology to Nab Speeders," Houston Chronicle, 2 Star Edition, Business Section, p. 2, Nov. 16, 1986.

"Traffipax—Radar Measurement in Moving Traffic—Traffipax unit type VM with digital tachometer and micro speed 09," Traffipax–Vertrieb, Düsseldorf, Germany, Sep. 1987.

"Traffic Electronics—Multafot–Front—Fully–automatic red Light Surveillance System with Frontal Photographs," Zellweger Uster AG, Uster, Switzerland, 1987.

Pigman et al., "Evaluation of Unmanned Radar Intallations," 14th International Forum on Traffic Records Systems, Jul. 1988.

Freedman, et al., "Public Opinion Regarding Photo Radar," *Insurance Institute for Highway Safety*, Arlington, VA 1989.

"Film analyzing simplified—Multascope," Multanova Brochure No. 007 2/492/500, Zellweger Uster Ltd., Uster, Switzerland, 1989.

"Multascope," Multanova AG Brochure No. 23 5a 007–2112.89_/ 1500, Zellweger Uster Ltd., Uster, Switzerland, 1989.

"Multacard System—Your 6F–radar measurements at a glance," Multanova AG Brochure No. 23 50 006–2/9 89/2000, Zellweger Uster Ltd., Uster, Switzerland, 1989.

"Multanova® Fully Automatic Radar Equipment 6FA," Multanova AG Brochure No. 23 50 009/11 91/1000, Zellweger Uster Ltd., Uster, Switzerland, 1989.

"Traffipax—Traffiphot—The Photographic Red–Light Monitor," Le Marquis Audio International, Inc., Garden City, New York, Mar. 1989.

"Data Recording Magazine with the DE–32 Module for Data Recording DM–100/200," Victor Hasselblad Inc., Fairfiled, N.J., Sep., 1989.

Blackburn et al., "Update of Enforcement Technology and Speed Measurement Devices," DOT HS 807584 Final Report, National Highway Traffic Safety Administration, U.S. Department of Transporation, Dec., 1989.

"PhotoCop™ Accident Reduction Program," Brochure, Traffic Monitoring Technologies, Friendswood, Texas 1990.

"PhotoCop™ Speed Control Accident Reduction Program," Brochure, Traffic Monitoring Technologies, Friendswood, Texas 1990.

"Photoradar—Automated Speed Enforcement," U.S. Public Technologies, Inc., Los Angeles, CA 1990.

"Traffipax Memory Card System," Traffipax–Vertrieb, Düsseldorf, Germany, Sep. 1990.

"Traffiscan—The Video System for Efficient Exploitation of Films" Traffipax–Vertrieb, Düsseldorf, Germany, Sep. 1990.

"Click! GTEL SPIE System Gives You the Numbers You Need," Brochure, GTEL Corporation, Wilmington, Delaware, 1991.

"Multistat—Stationary speed measuring system," Multanova AG, Uster, Switzerland, 1991.

"Traffipax Speedophot—Traffic Radar Unit with Automatic Recording," Traffipax–Vertrieb, Düsseldorf, Germany, Mar. 1991.

"Multanova—Moving Radar MR–6F," Multanova AG, Uster, Switzerland, Apr. 1991.

"PhotoCop® Speed Control Accident Reduction Program," pepared by Traffic Monitoring Technologies for West Valley City, Utah, Photo–Radar Review Committee, Apr. 1991.
"Traffipax—The Company," Traffipax–Vertrieb GMBH, Düsseldorf, Germany, Jul. 19, 1991.
Insurance Institute for Highway Safety Status Report, vol. 26, No. 8, Insurance Institute for Highway Safety, Arlington, Virginia, Sep. 14, 1991.
"Traffipax—Traffiphot–S, Stationary Speed Measuring Unit with Automatic Photo Recording" Traffipax–Vertrieb GMBH, Düsseldorf, Germany, Nov. 11, 1991.
"Multascope—Film analysing simplified," Multanova AG, Uster, Switzerland, 1992.
"Multagraph VT11—Traffic Monitoring with Video," Multanova AG, Uster, Switzerland, 1992.
Community Accident Reduction Effort Photo–Radar West Valley Police Brochure, West Valley City, Utah, 1992.
"Traffipax Traffic Surveillance Systems," Traffipax–Vertrieb, Brochure No. PMP 4.621, Dusseldorf, Germany Apr. 1992.
"Multanova 6FA Automatic–Radar installed on the motorway BAB9 'Nürnberg–München'" Multanova AG, Uster, Switzerland, Apr. 8, 1992.
"Multanova Speed measurement and red light control together in one unit," Multanova AG, Uster, Switzerland, Apr. 8, 1992.
"Automated Crash Reduction Systems—Overview—Services and Products," American Traffic Systems, Scottsdale, Arizona Nov. 1992.
"New Zealand Police Request for Tender 92/93/405 Vehicle Surveillance Equipment and Systems," American Traffic Systems, Scottsdale, Arizona (Jun. 17, 1993).
"Auto Patrol System," American Traffic Systems, Scottsdale, Arizona, submitted to Oxnard Police Department, Oxnard, California on Dec. 28, 1993.
"New Zealand Police Request for Tender 93/94/188 Static Vehicle Surveillance Equipment," American Traffic Systems, Scottsdale, Arizona (Feb. 4, 1994).
"Gatso Radar, Type 24," Gatsometer B.V., Overveen, Netherlands.
"Golden River Speed Enforcement System," Golden River Traffic Limited, Oxfordshire, England.
"Multacard System," Zellweger Uster Ltd., Uster, Switzerland.
"Multanova® Fully Automatic Radar Equipment 6FA," Zellweger Uster Ltd., Uster, Switzerland.
"Multanova® Road Safetey System," Zellweger Uster Ltd., Uster, Switzerland.
"Photo–Radar Automated Crash Reduction System," American Traffic Systems, Scottsdale, Arizona.
The PhotoCop Photo–Radar System, Traffic Monitoring Technologies, Friendswood, Texas 77546, Jan. 1990.
"Photo–Cop Photo–Radar Instruction Manual," Traffic Monitoring Technologies, Friendswood, Texas 77546, Jan. 2, 1990.
"Traffipax—Traffiphot—The Photographic Red–Light Monitor," Le Marquis Audio International, Inc., Garden City, New York.
"Traffipax—Traffic Radar Unit—Le Marquis–Micro Speed," Le Marquis Audio International, Inc., Garden City, New York.
"Vehicle Speed Radar," AWA Defence Industries Pty. Ltd., Adelaide, South Australia.
"Radar Control RC 110," Trafikanalys AB, Gävle, Sweden. (Brochure with radar unit on cover).
"Radar Control RC 110," Trafikanalys AB, Gävle, Sweden. (Brochure with roadway on cover).
"Automatic Radar Control ARC 110,"Trafikanalys AB, Gävle, Sweden.
"Autopatrol™ Photo–Radar Speed Enforcement," Brochure, American Traffic Systems, Scottsdale, Arizona.
Abstract collection, including abstracts of eleven German language articles (with English translation of the abstracts) and abstracts of twelve English–language articles.
"Camera Gets Black and White Evidence Against Speeding Motorist," Machine Design, Band 38, Nv. 2, Jan. 1966.
"Making Safety Happen," Brochure, American Traffic Systems, Scottsdale, Arizona.
"Automated Photographic Enforcement Systems," Brochure, American Traffic Systems, Scottsdale, Arizonaity, New York.
Lend/Lease Agreement between American Traffic System and City of Fort Meade.
James D. Tuton, President, American Traffic Systems, Response to Request for Proposal, Red Light Camera Enforcement Systems Equipment, Jul. 30, 1994.
Letter dated Aug. 8, 1994 from James D. Tuton, President, American Traffic Systems, to Chief George Farris, City of Fort Meade.
Letters to City of Fort Meade from American Traffic Systems, dated: Sep. 21, 1994; Sep. 28, 1994; Oct. 11, 1994; Nov. 11, 1994; Dec. 21, 1994; and Jan. 14, 1995.

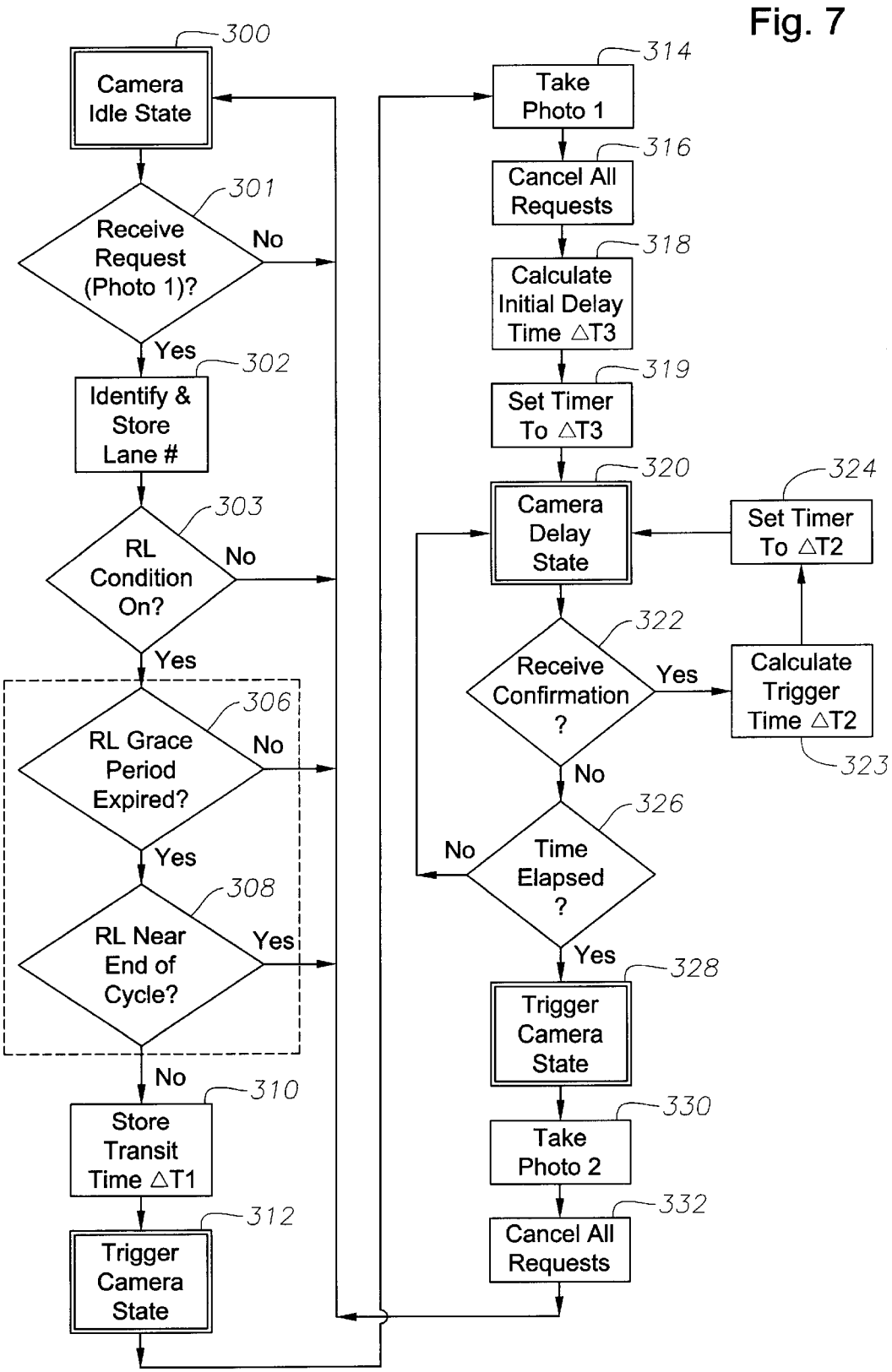
Fig. 7
300
Camera Idle State
301
Receive Request (Photo 1)?
No
Yes
302
Identify & Store Lane #
303
RL Condition On?
No
Yes
306
RL Grace Period Expired?
No
Yes
308
RL Near End of Cycle?
Yes
No
310
Store Transit Time ΔT1
312
Trigger Camera State
314
Take Photo 1
316
Cancel All Requests
318
Calculate Initial Delay Time ΔT3
319
Set Timer To ΔT3
320
Camera Delay State
324
Set Timer To ΔT2
322
Receive Confirmation ?
Yes
Calculate Trigger Time ΔT2
323
No
326
Time Elapsed ?
No
Yes
328
Trigger Camera State
330
Take Photo 2
332
Cancel All Requests

METHOD AND APPARATUS FOR PHOTOGRAPHING TRAFFIC IN AN INTERSECTION

BACKGROUND OF THE INVENTION

1. Field of the Invention

This invention relates to methods of monitoring and photographing vehicles. In a specific embodiment, the invention is directed to a method of accurately photographing a moving vehicle, preferably a vehicle traveling through a traffic intersection. Preferably, the vehicle is photographed in a predetermined zone within the intersection regardless of the speed of the vehicle, its travel pattern, or the length of the vehicle. Preferably, a selected portion of the vehicle is photographed, such as its license plate or tag.

2. Description of Related Art

Various systems for monitoring traffic in intersections have been proposed, but suffer from one or more shortcomings. Certain devices rely on a predetermined trigger time to take photographs of the vehicle after the vehicle passes over an induction loop in the road. However, in such systems the photograph sometimes "misses" the vehicle if the vehicle is moving either too fast or too slow. Other systems use sensors located at the point where the photograph is taken. U.S. Pat. No. 4,884,072 shows a traffic monitoring device that includes a camera for recording the image of the vehicle in a so-called "danger zone" that corresponds to an induction loop located within the intersection. That device has certain shortcomings, including the need to place the induction loop in the intersection at a point corresponding to the danger zone. Accordingly, the present invention is intended to provide an improved system for monitoring and photographing moving vehicles.

SUMMARY OF INVENTION

In a broad aspect, this invention relates to methods of monitoring and photographing vehicles. In a specific embodiment, the invention is directed to a method and apparatus for accurately photographing a moving vehicle, preferably a vehicle traveling through a traffic intersection in a predetermined zone within the intersection ("intersection zone"). Preferably, the vehicle is accurately and reliably photographed in the intersection zone regardless of the speed of the vehicle, its travel pattern (e.g., whether it hesitates or suddenly accelerates), or the length of the vehicle. Preferably, a selected portion of the vehicle is photographed, such as its rear license plate.

An apparatus of the invention includes a device for triggering a camera to photograph a vehicle within the intersection, where the triggering of the camera is dependent on the speed of the vehicle before entering the intersection and may also be dependent on presence information. The device includes a sensor system (or "sensor array") to transmit signals corresponding to a moving vehicle and a control system for processing the signals and triggering the camera. The signals preferably include "position signals" from which a transit time can be calculated, and "presence signals," from which presence information can be obtained, particularly the location of the rear of the vehicle or the location of the rear wheels of the vehicle. A trigger time for taking a picture of the vehicle may be calculated from the transit time.

The method includes the step of transmitting signals to a control system in response to the vehicle passing over a first traffic sensor and corresponding to the speed of the vehicle.

The method may also include the steps of transmitting presence signals to the control system, preferably corresponding to the presence of the vehicle in a known presence zone outside the intersection, and photographing the vehicle in response to those signals. In a specific embodiment of the invention, the triggering of the photograph is dependent on the speed of the vehicle. In another specific embodiment, the triggering of the photograph is dependent on the speed of the vehicle, as well as presence information. The system preferably uses a first set of signals (reflecting vehicle speed or transit time) and a second set of signals (reflecting the presence of the vehicle) to determine when to trigger the photograph of the vehicle in the intersection zone.

BRIEF DESCRIPTION OF DRAWINGS

FIG. 7 is a flow chart showing camera system timing.

DETAILED DESCRIPTION AND SPECIFIC EMBODIMENTS

Figure 2:
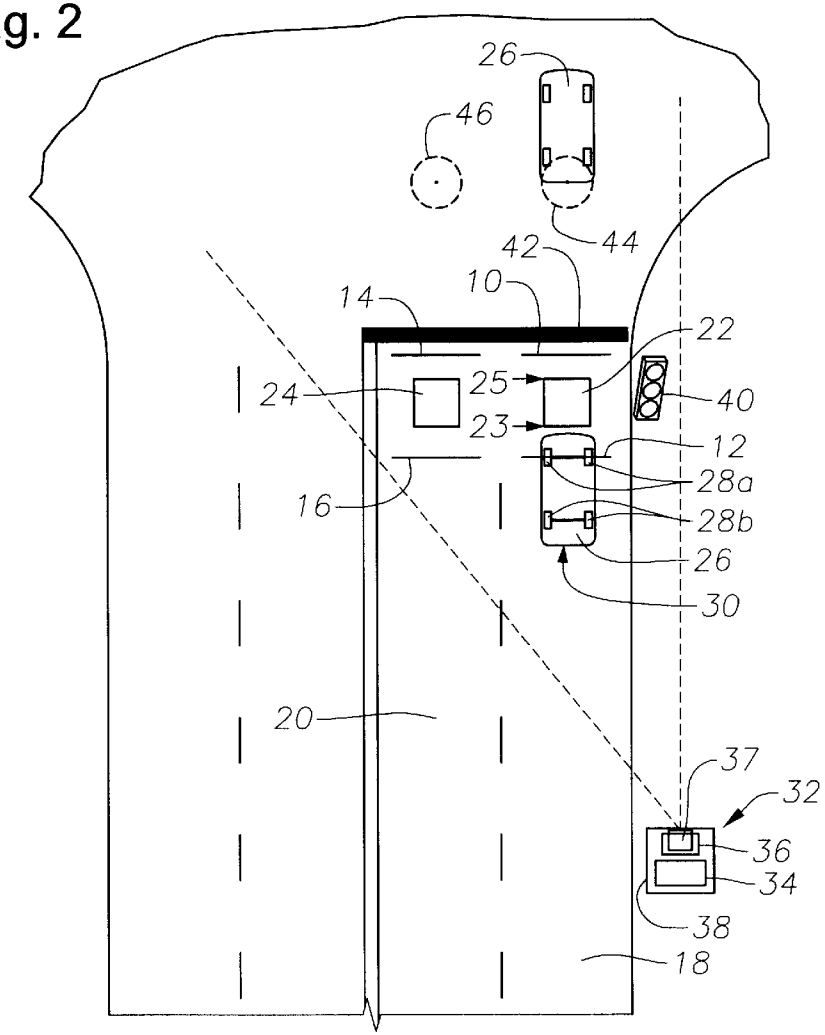
FIG. 2 is a schematic drawing showing a vehicle interacting with a sensor system which includes an induction loop and pair of position sensor cables.

Specific embodiments of the invention will now be described as part of the detailed description. In the drawings, like elements have the same reference numbers for purposes of simplicity. It is understood that the invention is not limited to the specific examples and embodiments, including those shown in the drawings, which are intended to assist a person skilled in the art in practicing the invention. Many modifications and improvements may be made without departing from the scope of the invention, which should be determined based on the claims below, including any equivalents thereof.

An apparatus of the invention includes a device for triggering a camera to photograph a vehicle within the intersection, where the triggering of the camera is preferably dependent both on presence information and on the speed of the vehicle before entering the intersection. The device includes a sensor system to transmit signals corresponding to a moving vehicle and a control system for processing the signals and triggering the camera. The signals preferably include "position signals" from which a transit time can be calculated, and "presence signals" from which presence information can be obtained, particularly the location of the rear edge of the vehicle or the location of the rear wheels of the vehicle.

Figure 3:
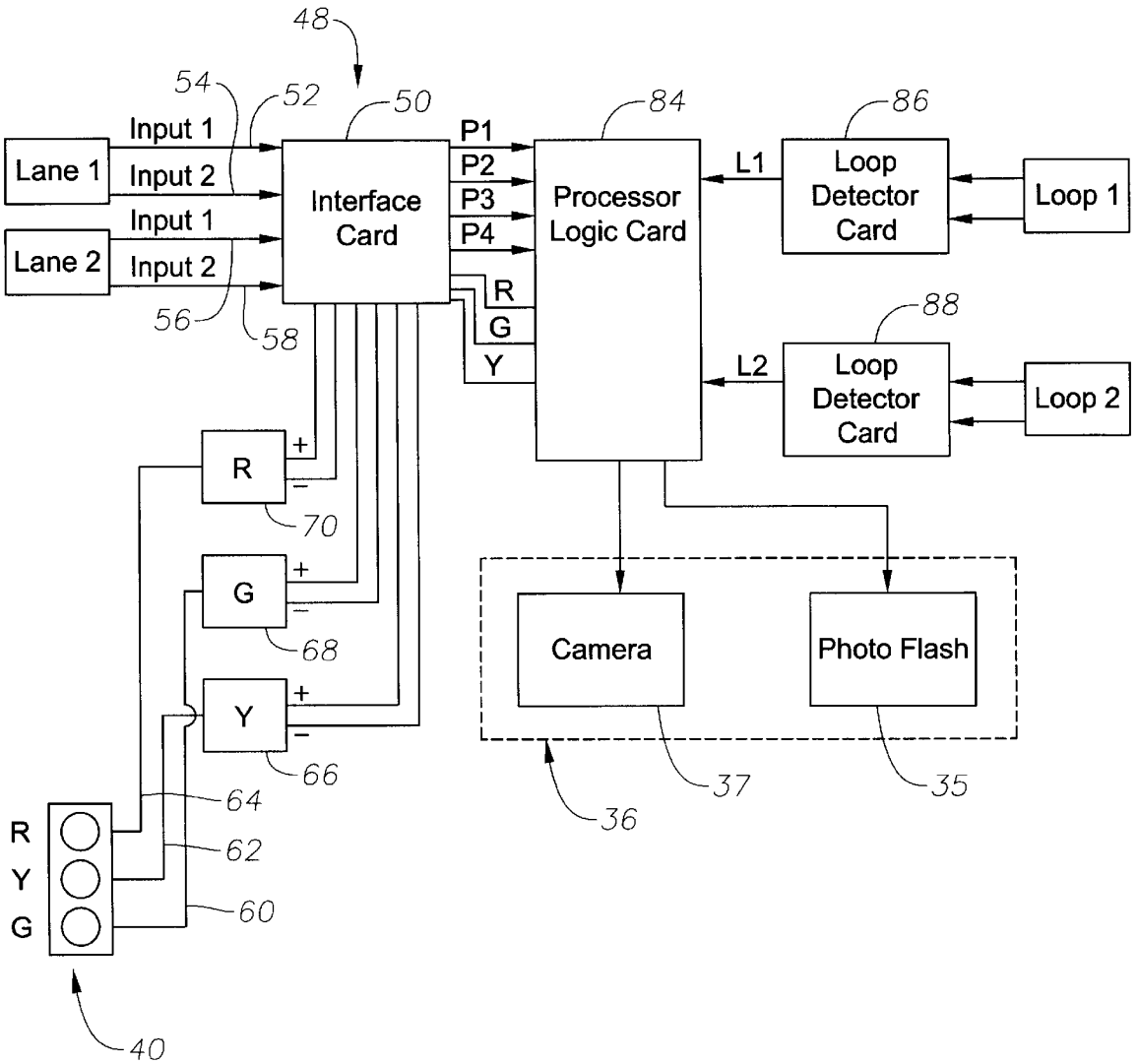
FIG. 3 is a system block diagram for a control system.
Figure 4:
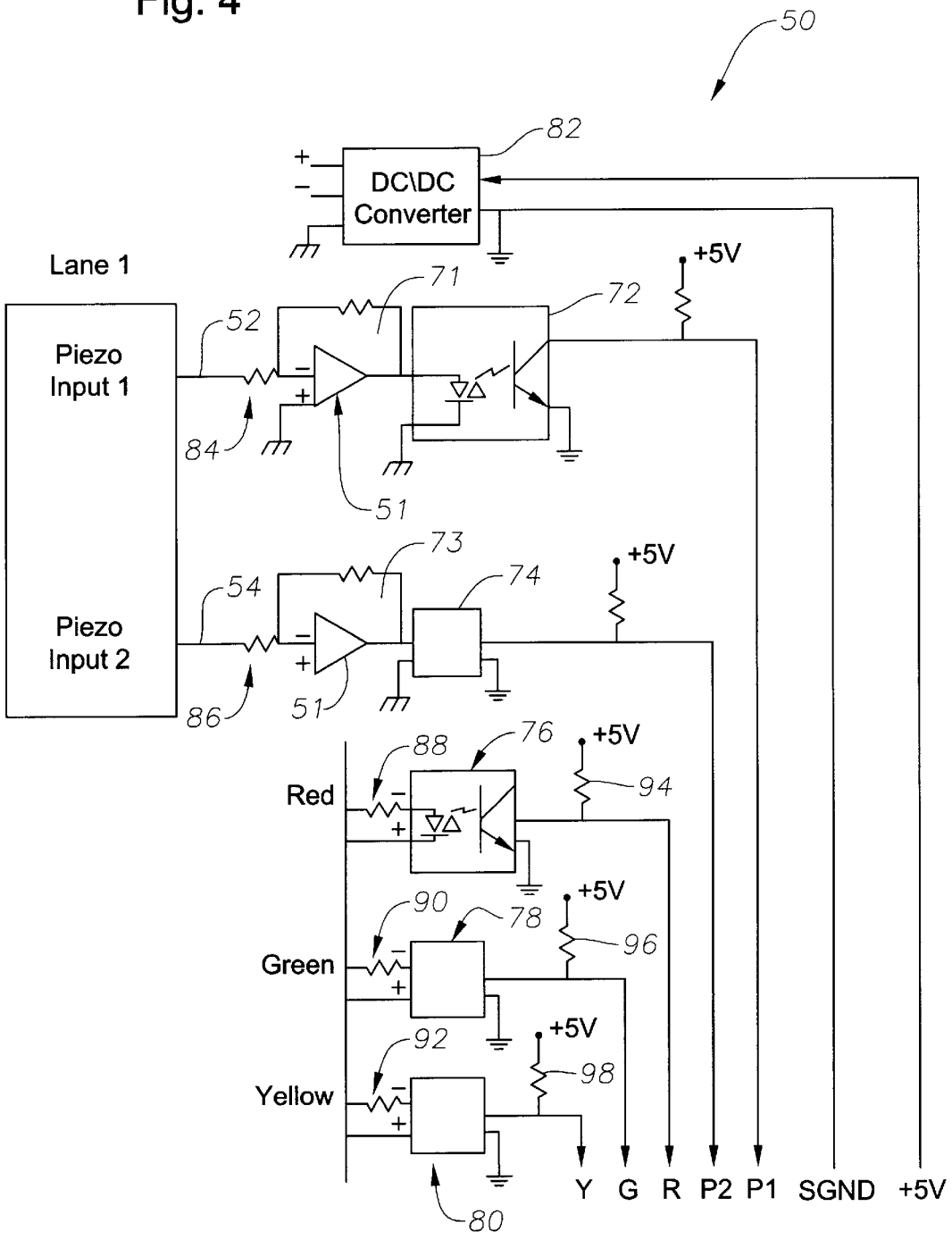
FIG. 4 is a logical block diagram for an interface card.
Figure 5:
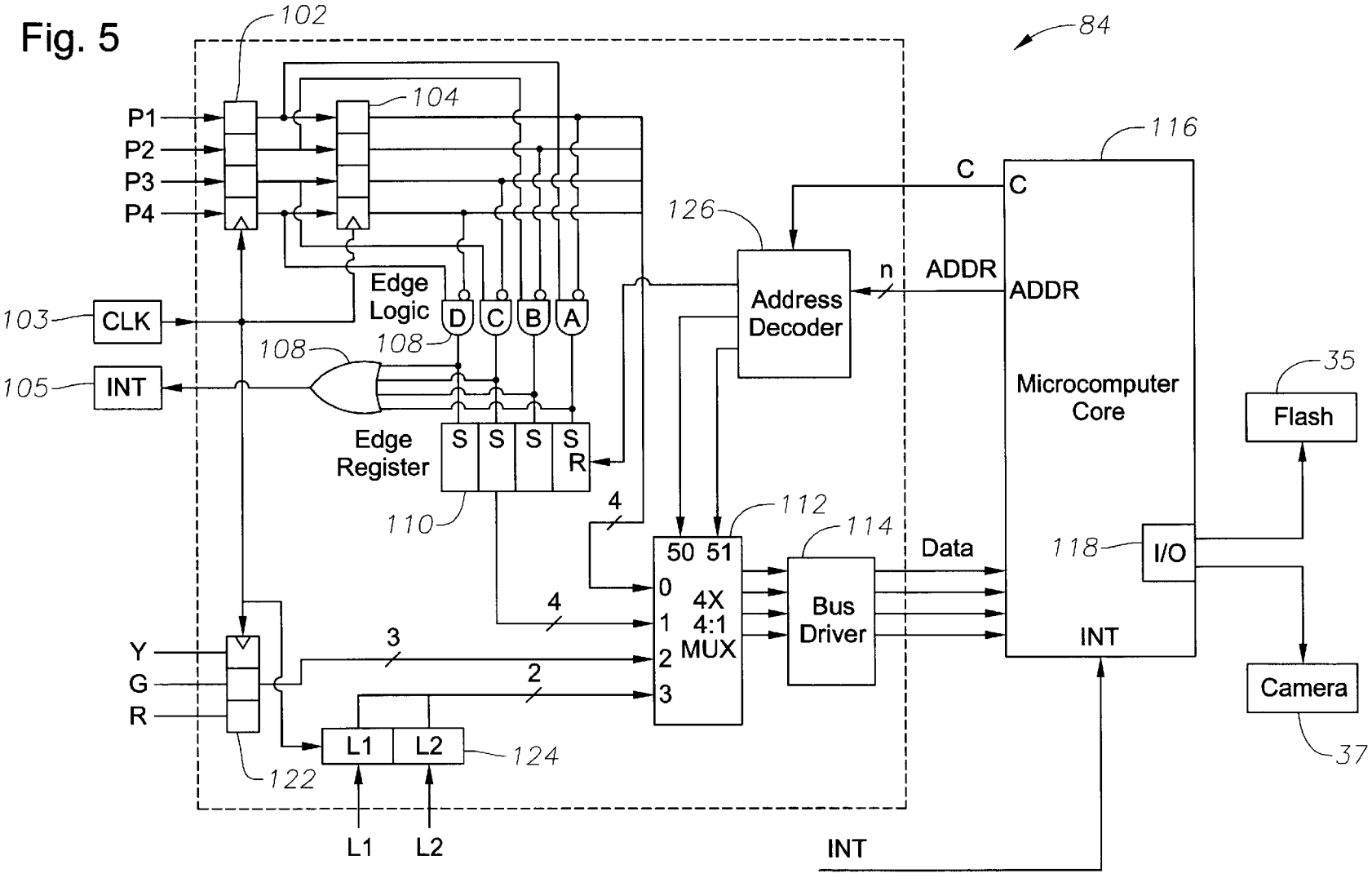
FIG. 5 is a block diagram for a processor logic card.

The sensor system preferably includes first and second traffic sensors, and may also include transmitters for sending to the control system the signals that are generated by the sensor system in response to various traffic events. In a specific embodiment, referring to FIGS. 1 and 2, a first traffic sensor preferably includes two spaced-apart position sensors 10 and 12 located in first lane 18 a predetermined distance from the intersection. Position sensors 14 and 16 are located in second lane 20. A position sensor of this invention broadly includes any device capable of detecting the position of a vehicle at a preselected point on the roadway, and is preferably a tire sensor that detects the pressure applied by a vehicle's tires. Accordingly, the position sensor preferably detects the passage of the vehicles' front and rear tires over the sensor. It is contemplated that a light emitting diode or "electric eye" system could also serve as a position sensor. However, a preferred position sensor is a pressure sensitive piezoelectric (piezo) cable or strip for creating a signal to be transmitted to the control system, where it is processed as shown in FIGS. 3, 4 and 5. Commercially available piezoelectric cables respond to pressure by measuring the degree of deformation of the roadway under vehicle loading. A transmitter may be provided to transmit a position signal to the control system in response to the passage of a vehicle over the position sensor.

Figure 1:
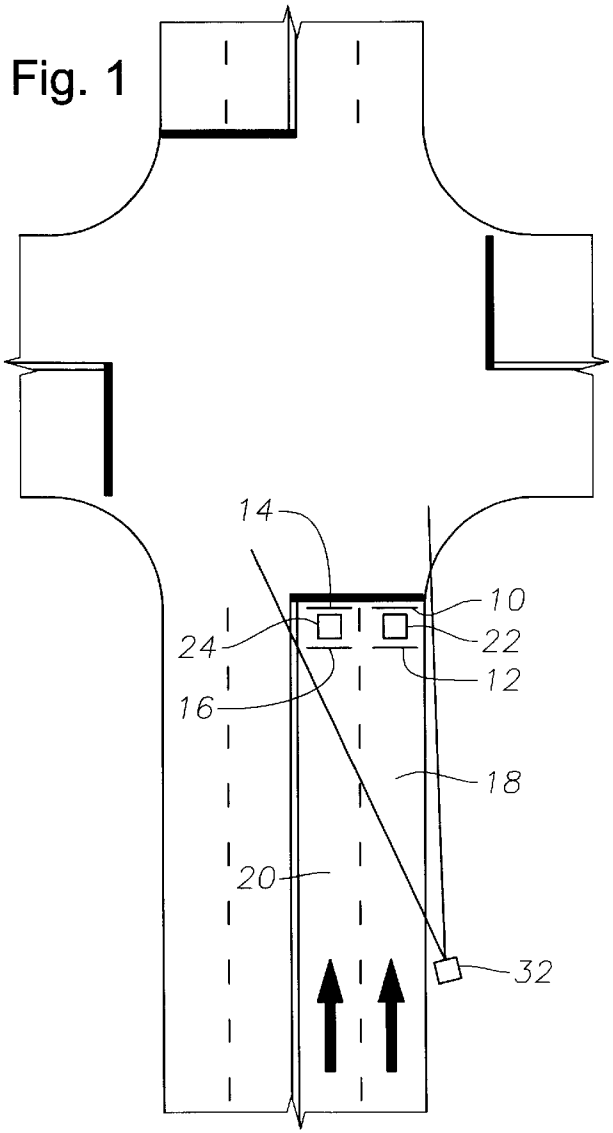
FIG. 1 is a schematic drawing of a traffic intersection showing a traffic light, sensor system, control system, and camera in accordance with a specific embodiment of the invention.

The control unit 32 in FIG. 1 includes a control system 34 as shown in FIG. 2 contained in housing 38 which also contains a camera system 36 that includes a camera 37. A vehicle 26 is shown in FIG. 2 with front tires 28*a* and rear tires 28*b* and a rear edge 30 where the rear license plate may be located. The first set of signals preferably includes first and second position signals, and is responsive to the vehicle passing over the first traffic sensor. In a specific embodiment, the method includes transmitting a first position signal to the control system responsive to the passage of the vehicle over the first position sensor and transmitting a second position signal to the control system responsive to the passage of the vehicle over the second position sensor.

In a specific embodiment of this invention, a first sensor signal is transmitted to the control system 34 when the front tires 28*a* of a vehicle 26 pass over the first position sensor 12. A timer may be activated during a red light condition of the traffic signal 40. A second position signal is transmitted to the control system 34 when the front tires 28*a* of the vehicle 26 pass over the second position sensor 10. A transit time may then be calculated from the two position signals. The transit time may be compared in the control system to a predetermined value to determine whether, based on the speed of the vehicle, a traffic violation is likely to occur. If so, a first "pre-violation" photograph of the vehicle is taken. Preferably, the pre-violation photograph is taken of the vehicle when the light is red and the vehicle has not yet crossed over the intersection stop bar 42. In this manner, the vehicle is not photographed as a violator if it crosses the stop bar while the light is still in the yellow condition. The transit time is preferably stored in memory, which may be part of the control system, for later use in triggering the camera to photograph the vehicle in a second photograph zone, e.g., the preselected intersection zone.

The signals may include a second set of signals, which may include "presence signals," which may be provided by a presence sensor. A presence sensor of this invention includes any device capable of detecting the presence (and absence) of a vehicle. Unlike the position sensor, the presence sensor is capable of detecting the entire body of the vehicle, not merely the tires. A sensor system preferably includes a combination of position sensors and presence sensors. With such a combination, the presence sensor detects whether tires hitting the position sensors belong to the same vehicle. Referring to FIGS. 1 and 2, in a particularly desirable aspect, the presence sensor 22 should also be capable of detecting the trailing edge 30 of a moving vehicle 26. The presence sensor 22 is preferably a conventional induction loop, such as the one disclosed in U.S. Pat. No. 4,884,072. The induction loop detects the presence of the vehicle over the area bounded by the induction loop and provides presence output signals accordingly.

The control system of this invention broadly includes any circuitry capable of receiving and processing the signals transmitted from the sensor system in accordance with the invention. In a specific embodiment, the control system 34 in FIGS. 1 and 2 preferably includes a programmed microprocessor and any other circuitry capable of using the transmitted signals from the traffic sensor system to trigger a camera. Control systems in general are conventional and need not be discussed in detail. A control system is disclosed in U.S. Pat. No. 4,884,072, which is incorporated by reference to the extent it is not inconsistent with the present invention. Microprocessors capable of processing the signals provided by the sensor system are conventional and will also not be described in detail. Aspects of a preferred embodiment of the control system are discussed below with reference to FIGS. 3–7.

The control system 32 preferably includes circuitry for receiving and processing the condition of the traffic light, e.g., red, green or yellow. In accordance with a preferred embodiment of the invention, if the light condition signal transmitted to the control system is de-asserted for three simultaneous samples, then the light is considered to be "off." If the light condition is asserted for any sample, then the light is considered to be "on." The light is not determined to be "red" unless a red light signal is received. A green light signal or a yellow light signal precludes a determination that a red light is activated. In a specific embodiment, a red light signal is not processed as a red light condition until a grace period of approximately 1 second has passed. In another embodiment, a red light signal received from the traffic light is disabled for a period of time at the end of the red light cycle. In this manner, a vehicle that crosses the intersection bar when the light is red but reaches the intersection zone after the light has turned green will not be photographed. The traffic light condition and the induction loop outputs may be programmed into a programmable logic device as a separate byte in the processor I/O space, which may be polled by the processor at a high rate of speed.

The method of the invention preferably includes photographing a vehicle 26 while the vehicle is within a preselected intersection zone 44. The method includes transmitting signals to the camera system 36 to trigger the camera 37 and record the image of the vehicle in the preselected intersection zone 44 or 46. The image may be recorded in a photograph, which may be generated in any number of ways familiar to those skilled in the art, including recording the image on film or by recording the image on a charge-coupled device in digitized form.

An important aspect of the invention is the timing of the photographs. Preferably the camera is triggered to photograph the vehicle 26 within the preselected intersection zone 44 after a calculated trigger time has elapsed. The trigger time is variable and should depend on the speed and dimensions of the vehicle. The trigger time should be based on a transit time that reflects the measured speed of the vehicle. A preferred transit time is the measured time elapsed between the passage of the front tires of the vehicle over the first position sensor 12 and the passage of the front tires of the vehicle over the second position sensor 10. In a particularly preferred aspect, the method also uses the presence of the vehicle in relation to the presence zone to trigger the camera to photograph the vehicle within the preselected intersection zone. In FIGS. 1 and 2, the presence zone is defined by the induction loop 22, but may also include the area between the two position sensor 10 and 12. A "default" picture is taken in case the vehicle is not photographed within the preselected intersection zone. It may be photographed before or after the vehicle has passed the intersection zone.

A particularly desirable feature of the invention is the step of transmitting presence signals to the control system 34 and using those signals in deciding when to photograph the vehicle in the intersection. The signals may be responsive to the presence of the vehicle within a preselected "presence zone" that is located a known distance from the intersection zone. As used herein, the determination of a vehicle's "presence" also conversely includes a determination of the absence of the vehicle from the presence zone. In a specific embodiment, the presence signals are responsive to the presence of the vehicle over an induction loop 22 buried in the road and located outside the intersection zone. When the rear edge 30 of the vehicle 26 passes over the trailing edge 25 of the induction loop (the part of the loop closest to the intersection) a signal is transmitted indicating a shift from "presence" to "absence" of the vehicle, i.e., a "drop-out." A photograph is then taken after a calculated trigger time has elapsed.

In a preferred embodiment, a camera 37 is triggered to photograph the vehicle 26 within the intersection in a manner that is dependent on vehicle speed. For example, the triggering of the photograph is preferably based on a transit time, calculated based on position measurements of the vehicle taken before the vehicle enters the intersection. In another specific embodiment, the triggering of the photograph is also based on a sensed event relating to some part of the position of the vehicle to be monitored. The sensed event may be the passage of the vehicle over the intersection stop bar 42, or it may be the passage of the vehicle over or through a piezoelectric strip buried in the road (e.g., sensor 10). The sensed event may also be passage of the vehicle over some portion of an induction loop 22 that senses presence information about the vehicle and sends signals or impulses responsive to the control system 34 for evaluation. Preferably, the sensed event is the passage of the rear 30 of the vehicle 26 over the trailing edge 25 of the induction loop 22, and the trigger time is calculated as a predetermined multiple of the transit time. After the rear 30 of the vehicle 26 passes over the trailing edge 25 of the induction loop 22, the camera 37 waits until the trigger time has elapsed before the picture is taken. Alternatively, if the sensed event is the passage of the rear tires 28*b* over the second position sensor 10, then the camera waits until the trigger time elapses after that position signal is transmitted before a photograph is taken.

In a specific embodiment of the invention, when a vehicle runs over one of the piezoelectric sensors, the sensor creates a voltage, which is then detected and transmitted as a negative squared signal using an optoisolator. As seen in FIG. 3, each lane provides input position signals to the control system. The high to low transition of each signal causes a bit to be latched in a transition register in the control system and signals an input capture event to the processor. The processor should be configured so that the input capture captures its internal clock time stamp of when that event occurred, and the processor interrupt services that event. The processor reads the event latch and determines which of the position sensors was triggered and associate that sensor with its internal clocking of when that event occurred. Advantageously, because the latching is independent of the position sensors, accurate measurements of substantially simultaneous events are possible. Those events may be accurately timed both as single events and as multiple events timed within a known timing window, which is the time since the input capture was last serviced by the processor.

Both the position and presence signals may be transmitted to a programmable logic device (PLD), such as a programmable logic array on a circuit board. A Lattice ISP device may be used as the PLD. However, standard digital logic elements may also be used. The PLD accepts opto-isolated signals derived from the traffic light 40 indicating the presence of activation voltage on light bulbs in the traffic light 40. The PLD receives the position signals and latches the negative (true) transition bits, thus creating a positive logic signal indicating that a vehicle has passed the position sensor. The bits are latched independently for each position sensor and are available to the processor as separate bits in a register byte which is programmed into the PLD so that the processor is capable of reading which transitions have occurred. The term "transitions" refers to the negative going edge of the position detector signals P1–P4. Reading the bits automatically clears the edge of transition register so that reading the transition status clears out any transitions until new transitions occur. The transitions are only latched when the leading edge of the signal from the sensor is present, indicating the initiation of a vehicle hitting the position sensor. When any bits are set in the edge of the position indicator register, an interrupt is activated and sent to the processor telling the processor that a significant event has occurred on the induction loop. The interrupt is routed through one of the processor's input capture control pins, which freezes the time of the interrupt on the processor's internal clock counter into a register indicating not only that a transition has occurred, but also when that transition occurred relative to the clock counter. The edge latch may be polled at any time by a processor operating in polled mode.

Reference is now made to FIG. 3, which shows a system block diagram for a sensor and processor system. As discussed above, a separate sensor system may be provided for each lane, and the signals from each of those sensor systems may be processed in a single control system. The timed positions of the car wheels are sensed by piezoelectric cables buried 10, 12, 14, 16 in the roadbed, which are spaced a uniform distance apart as shown in FIG. 1. Induction loops 22, 24, each serving as a presence sensor, are preferably located between the position sensors, although the induction loops could also be located elsewhere. A benefit to placing the induction loops between the position sensors is that the induction loops are able to detect whether the tires detected by the position sensors belong to the same vehicle. The piezo cables are wired into an interface card 50, which as shown in FIG. 4 amplifies the signals and sends them as digital pulses through opto-isolated drivers to the processor logic card. The interface card 50 is connected to the traffic light drive voltages 60, 62, 64 through isolation step down transformers 66, 68, 70. Referring to FIG. 4, traffic light signals are transmitted to the interface card 50 through opto-isolators 76, 78, 80. A separate interface card is preferred to contain any environmental damage from lightning strikes to one easily replaceable unit and to protect the remainder of the processor system from damage. Preferably, the interface card 50 also includes a DC to DC converter 82 to provide electrically isolated power to the piezo amplifiers 51.

Referring now to FIG. 4, a schematic diagram is shown of the interface card 50 of FIG. 3. The processor logic card 84 preferably provides a five volt signal between a +5V signal and a secondary ground signal SGND to a DC/DC converter 82 located on the interface card 50. The DC/DC converter 82 provides positive (+) and negative (−) power signals referenced to a primary ground PGND for providing power to amplifier elements 71, 73 and optocoupler circuits 72, 74 on the interface card 50. The Y, G, R and two piezo cable signals (P1 and P2) are all normally pulled to a high logic level through pull-up resistors to the +5 signal. A first piezo input 52 is provided to the input of an amplifier circuit 71, which provides its output to the input of an optocoupler 72. In this manner, when the tire of a vehicle crosses over the corresponding energized piezo cable 12, a voltage pulse is asserted the input of amplifier circuit 71, which provides an amplified voltage pulse through the internal light emitting diode (LED) of the optocoupler 72, which in turn activates the internal transistor of the optocoupler 72, thereby temporarily grounding the P1. The same procedure is followed for the second piezo input. Similar circuits are provided for generating piezo signals P3 and P4 for the second lane. In this manner, the P1, P2, P3 and P4 signals are normally asserted high but pulsed low in response to detecting a vehicle's tires crossing the corresponding piezo cable.

Red, green and yellow signals from the step-down transformers 70, 68, 66 interfacing the traffic light are each provided to the inputs of corresponding optocouplers 76, 78, 80. The processor samples the AC signals from the traffic light I/O in such a way as to not synchronize the samples as zero crossings of the voltage. The output of those optocouplers assert the R, G and Y signals, which are pulled high through pull-up resisters 94, 96, 98 to the +5V signal. When the red, green or yellow light is activated, current flows through the internal LED of the optocouplers 76, 78, 80 thereby asserting low the corresponding R, G or Y signal. In this manner, the R, G and Y signals are normally high, but are asserted low when a corresponding light bulb within the traffic light is activated or otherwise turned on.

Referring now to FIG. 5, a schematic and block diagram of the processor logic card 84 is shown. In a preferred embodiment, the first logical block includes a processor core 116 which may be a microprocessor, preferably a standard 68HC11 processor running in extended memory configuration and having external memory, decode logic and processor I/O registers, which are interfaced to a camera 37 and flash synchronizer 35 making up the camera system 36. The processor, digital camera and flash synchronizer are of standard design and thus will not be discussed in detail. The processor logic card 84 receives additional isolated logic signals L1 and L2 from standard loop detector cards 86, 88 which are connected to the induction loops 22, 24 set into the pavement between the piezoelectric cables 10, 12, 14, 16 in the sensor system. The processor logic card 84 processes the sensor and traffic light signals as shown in FIG. 3 and triggers the automated camera 37 by sending signals through digital control lines to cause the camera to take pictures. In another aspect (not shown) film line annotations may be written on the frames taken. The processor logic card 84 also provides a synchronized flash trigger signal to a standard photoflash unit 35 to help illuminate the photos taken.

The second logical block of the processor logic card (or board) is preferably implemented in a PLD having programmed logic as shown in FIG. 5. A purpose of the circuitry in the PLD is to ease the processor's burden in reading and timing the events that go into processing the sensor signals and timing of photographs. Piezo signals P1, P2, P3, P4 enter in digital form and are latched in a synchronizing latch 102 attached to the system logic clock (CLK) 103. This eliminates races in the internal logic since the signals can transition at any time. The synchronized outputs change at a time determined by the processor system clock which the processor would not be reading. The light signals Y, G, R and the loop detector signals L1 and L2 all go through similar synchronizing registers. The piezo signals go through additional logic which detects false to true transitions and latches the occurrence of the transitions for the processor to read at a later time from the edge register. Each piezo signal P1, P2, P3, P4 pulses whenever any of the piezoelectric sensor cables indicates the car's wheels have crossed the cable. These pulses are sent to the processor's interrupt timer input which signals the processor that an event has occurred and latches the time of that occurrence into an input capture register in the processor, which indicates to the processor that a traffic event has occurred and when it occurred (within ±500 nanoseconds). The processor then reads from the PLD logic which position sensor (e.g., cable) triggered the event, i.e., not only whether the event was triggered by a vehicle passing over the first or second cable, but also the lane in which the event occurred. This is accomplished by reading the edge register 110 through the multiplexer MUX 112 logic on the PLD through the bus driver 114 logic. At this time, the processor 116 can read the condition of the traffic light and the traffic loops through the MUX. Normally, these signals are polled several hundred times a second to keep up with their state. Another feature shown in FIG. 5 is the clearing of the edge register 110 by reading its value. This clearing feature facilitates counting the false to true transitions of the piezo sensors as they occur.

The P1, P2, P3 and P4 signals from the interface card 50 are provided to the respective inputs of a four bit latch 102, which receives a system clock signal CLK at its clock input. The respective outputs of the latch 102 are provided to the four inputs of another latch 104, also receiving the CLK signal at its clock input. The outputs of the latch 104 are provided to the inverting inputs of four corresponding two-input AND gates 106A–D, respectively, and also to the first set or logic "0" input of a four-bit 4:1 multiplexer (MUX) 112. The four respective outputs of the latch 102 are provided to the other inputs of the AND gates 106A–D, and the outputs of the AND gates 106A–D are provided to the respective inputs of a four-bit edge register 110. The outputs of the AND gates 106A–D are also provided to the four respective inputs of a four-input OR gate 108, which asserts an interrupt signal INT at its output. The four outputs of the edge register 110 are provided to the second set or the logic "1" input of the MUX 112.

The Y, G and R signals are provided to the inputs of a three-bit latch 122, which receives the CLK signal at its clock input. The three output bits of latch 122 are provided to the third set or logic "2" input of the MUX 112. The L1 and L2 signals from the respective loop detector cards are provided to a two-bit latch 124, which receives the CLK signal at its clock input. The two outputs of the latch 124 are provided to two bits of the fourth set, or logic "3," input of the MUX 112.

The four output bits of the MUX 112 are provided to the inputs of a bus driver 114 for providing four buffered data bits to the processor 116, which receives the INT signal as its interrupt input. The processor 116 also provides an n-bit address signal (ADDR) and a control signal C to the inputs of an address decoder 126 of the processor logic card 84. The address decoder 126 asserts the S0 and S1 select inputs of the MUX 112 for selecting between the logic 0–3 inputs of the MUX 112. The address decoder 126 also provides a reset signal R to the edge register 110 immediately following the reading of the register.

Operation of the processor logic card 84 is as follows. The P1–P4 signals are continually sampled by latch 102 on the rising edge of the CLK signal. The CLK signal preferably operates at approximately 2 megahertz (MHZ) for sampling the data within ±500 ns. Likewise, the Y, G and R signals are sampled by the latch 122, and the L1 and L2 signals are sampled by the latch 124 upon rising edges of the CLK signal. The output bits of the latch 102 are sampled on each rising edge of the CLK signal through the latch 104. The outputs of the latches 102 and 104 are monitored by the AND gates 106A–D for detecting an event, such as the presence of an automobile approaching the intersection and crossing a piezo cable. For example, if the P1 signal is asserted low, the latch 102 latches the zero bit to its output, which zero output bit is detected by the latch 104 on the next rising edge of the CLK signal. Eventually, the P1 signal goes high, at which time it is detected by the latch 102 on the next rising edge of the CLK signal. In this manner, the output of the respective bit of the latch 102 is high, while the corresponding output bit of the latch 104 is low. The AND gate 106A detects the output of latch 102 high and the output of the latch 104 low and asserts its output high. The output of the AND gate 106A going high is detected by the OR gate 108, which asserts the INT signal to the processor 116 and sets the appropriate bits in the edge register 110.

In response to the INT signal being asserted by the processor logic card 84, the microcomputer 116 asserts an n-bit address ADDR to the address decoder 126, as well as a control signal C, for reading the MUX 112. In the preferred embodiment, the processor 116 controls the address decoder 126 to sample the respective bits of the four logic input sets of the MUX 112 one at a time. Thus, the address decoder 126 asserts the S1, S1 signals in the appropriate order for sampling the latch 104, the edge register 110, the latch 122 and the latch 124. Upon sampling the output of the edge register 110, the address decoder 126 asserts the reset signal to reset the edge register 110 for preparing the processor logic card 100 for the next interrupt. The processor 116 therefore samples the contents of the P1–P4 signals through the latch 104 and the edge register 110, the Y, G and R signals through the latch 122 and the L1 and L2 signals through the latch 124. The processor 116 then performs the desired calculations, described further below, for determining when to assert I/O signals through an I/O logic 118 to the flash 35 and the camera 37.

Figure 6:
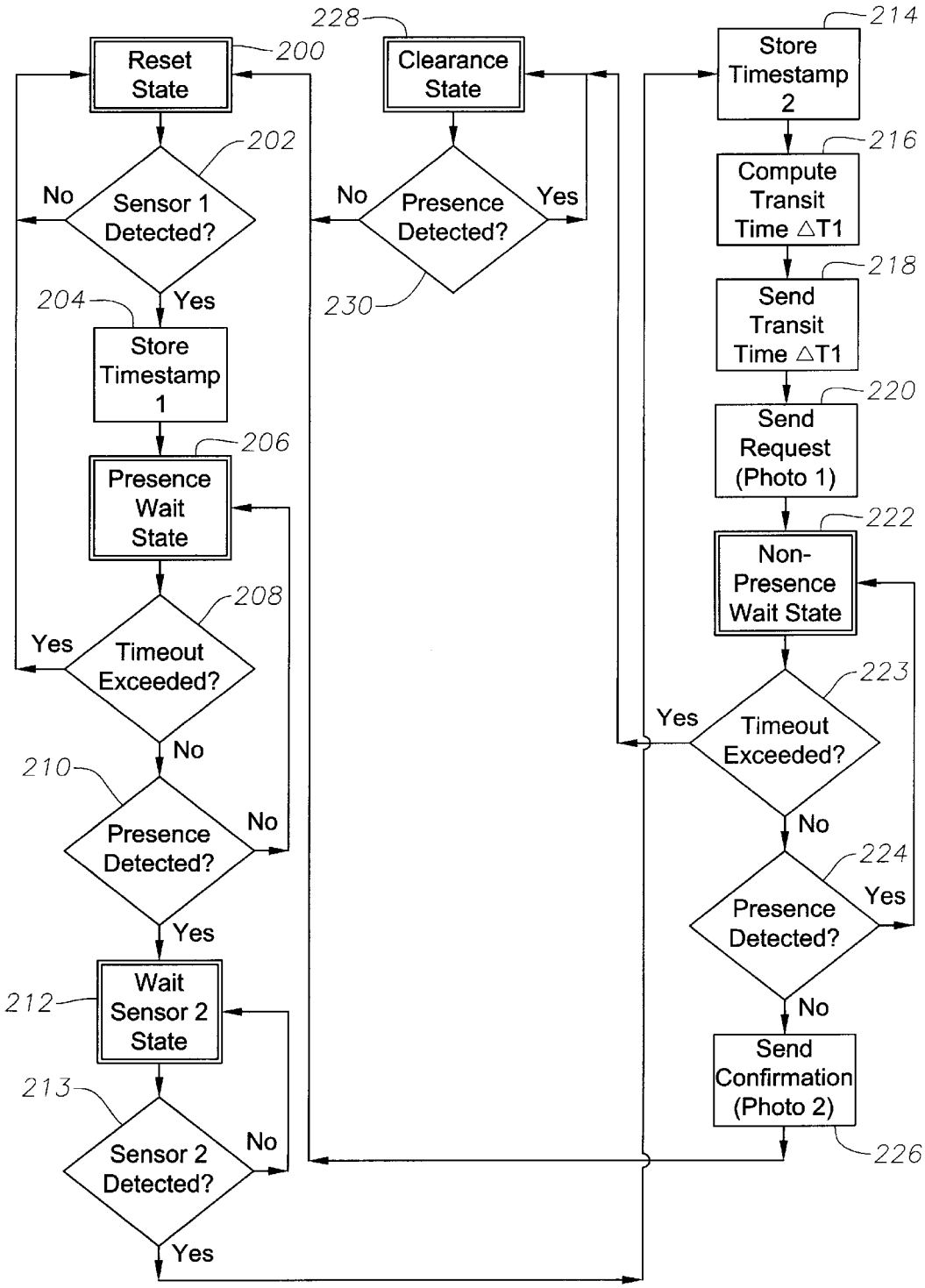
FIG. 6 is a flow chart showing sensor system timing.

The control system processor supports a programmed control procedure as discussed below and as shown in FIGS. 6 and 7. The flow chart in FIG. 6 shows a method which may be programmed into the processor, e.g., in the form of an algorithm, to process the signals received from the sensor system. The flow chart in FIG. 7 shows a method which may also be programmed into the processor to control the timing of the camera. As will be recognized by persons skilled in the art, the methods shown in FIGS. 6 and 7 may be implemented using conventional programming techniques. In a preferred embodiment, signals are transmitted from individual sensor systems arranged in separate lanes, and each lane's signals are processed independently in accordance with the following method shown in FIG. 6. Such individualized sensor systems, each restricted to a single lane and processed separately, offer certain improvements over devices having an induction loop spanning across several lanes.

Referring now to FIG. 6, the method may be implemented in a state machine or in software that simulates a state machine as described below. Each state is identified by a bordered rectangle; conditions are identified by diamonds; and events and actions are identified by borderless rectangles. For convenience, the method shown in FIG. 6 will be described with reference to a vehicle's interaction with a sensor system exemplified in FIG. 8. The control system begins in the RESET state 200 prior to the passage of a vehicle over the first position sensor 12. When the vehicle reaches location 500, and the vehicle's front tires hit the position sensor 12, the position sensor transmits a signal to the control system indicating that the front wheel of a vehicle has been detected. When condition 202 is activated, a time stamp is stored 204, e.g., using a clock in the microprocessor. The system then exits the RESET state and enters the PRESENCE WAIT state 206. If the presence sensor is not activated 210 in the PRESENCE WAIT state within a predetermined time 208 ("time out"), the control system reverts to the RESET state 200, reflecting a non-recordable event, for example, a false reading, or a vehicle backing up over the sensor, or the vehicle stopping on the first position sensor but not continuing over the presence sensor. But if the presence sensor (e.g., induction loop 22) is activated 210 within the predetermined time by sending presence signals to the control system (for example, if the vehicle is at location 501) then condition 210 is met, and the system moves to WAIT SENSOR 2 state 212, where the control system waits for the front tires to be detected by the second position sensor 10. In the WAIT SENSOR 2 state, when the vehicle reaches location 502, signals are transmitted to the control system from the second position sensor 10, and condition 213 is satisfied. A second time stamp corresponding to the passage of the vehicle over the second position sensor may be stored in memory (event 214). A transit time ΔT1 may then be calculated 216 based on the difference between the first and second time stamps. The calculated transit time ΔT1 is sent (event 218) to the camera processing system (see FIG. 7). As an additional feature, the transit time may be compared to a predetermined value or time threshold to determine whether a violation is likely to occur (not shown). If the transit time is above the predetermined value, then a decision is made that the vehicle is traveling too slow, and a photograph is not requested.

When the transit time ΔT1 is sent, a REQUEST FOR PHOTO 1 is also sent. The system then moves to the NON-PRESENCE WAIT state 222. There, the signals from the presence sensor are monitored to determine when a presence "drop-out" has occurred, that is, when the vehicle is absent or is no longer present within a presence zone, e.g., the area over the induction loop. If signals from the presence sensor do not indicate that the vehicle has left the presence zone within a predetermined time period, an inference is made that the vehicle has stopped over the induction loop and will not enter the intersection or violate the traffic signal. As shown in FIG. 7, a predetermined "time out" period may be programmed in the system, which checks for continual presence of the vehicle during that period. The system remains in the NON-PRESENCE WAIT state 222 until one of two conditions occurs. The first condition 223 is met if the time out is exceeded, causing the system to go to the CLEARANCE state 228 where it remains until presence is no longer detected 230 after which it reverts to the RESET state 200. The second condition 224 is met if presence is no longer detected. If presence is not detected and the time out has not been exceeded, a SEND CONFIRMATION event 226 is activated. For example, if the rear edge of the vehicle has passed over the trailing edge 25 of the induction loop, and the vehicle is at location 504, the vehicle will no longer be present in the presence zone. In accordance with a specific embodiment of the invention, the sending of the CONFIRMATION indicates that the position of the rear of the car has been located and corresponds to a known point. The sending of the CONFIRMATION triggers (activates) the camera to take a photograph of the vehicle after an appropriate delay, preferably determined by the method of FIG. 7. After sending the CONFIRMATION, the system returns to the RESET state 200.

The flow chart in FIG. 7 shows a procedure for timing photographs in accordance with a specific embodiment of this invention, i.e., triggering the camera using the outputs from FIG. 6. Each set of outputs corresponds independently to a separate lane in accordance with the method shown in FIG. 6. Thus, for example, the processor preferably runs through steps in FIG. 6 for the first lane and independently runs through the same steps in FIG. 6 for the second lane. Each lane thus provides independent outputs to a single camera processing sequence shown in FIG. 7, which shows a method for operating a camera system in conjunction with a control system. In general, the camera system may be triggered to photograph a vehicle at different locations with respect to the intersection. For example, the camera may be triggered to photograph the vehicle prior to its entrance to the intersection while the traffic light is red (pre-violation). It may also be subsequently triggered to photograph the vehicle while it is inside the intersection, e.g., at the intersection zone. It may also be triggered to photograph the vehicle at some other point, e.g., a default photograph. In any of those cases, the control system transmits signals to the camera system resulting in the triggering of those photographs. The method shown in FIG. 7 is preferably programmed in the control system 34 and operates in accordance with the circuitry shown in FIGS. 3–5. The method shown in FIG. 7 will be described with reference to a state machine, where the states are indicated by bordered rectangles and conditions and events indicated by borderless rectangles.

Figure 8:
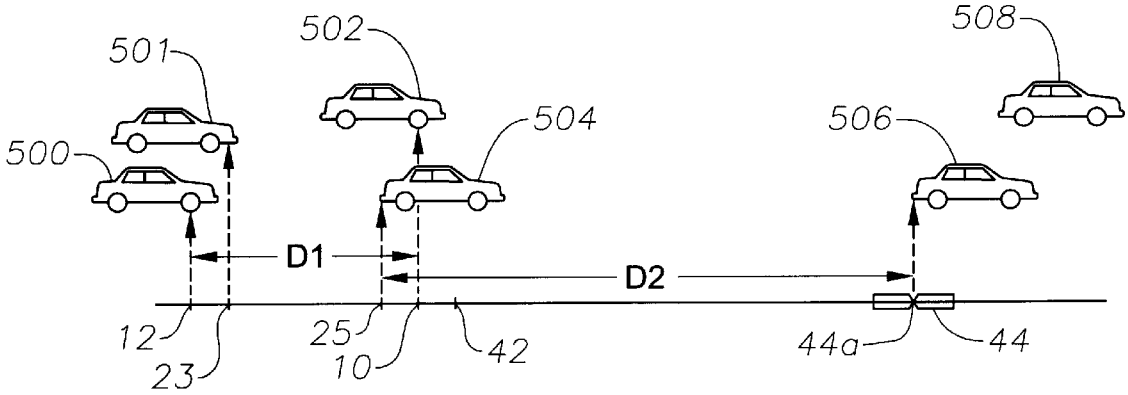
FIG. 8 is a schematic diagram showing a vehicle and sensor system.

Referring now to FIGS. 7 and 8, in a specific embodiment, the camera system begins in the CAMERA IDLE state 300. In the CAMERA IDLE state, if output is provided from FIG. 6 for any one of the lanes, the output for that lane (e.g., a transit time ΔT1, a REQUEST and a CONFIRMATION) will be processed in accordance with the method shown in FIG. 7. Any subsequent output for any other lane will be ignored. In the CAMERA IDLE state 300, if a REQUEST has been sent (from FIG. 6), then RECEIVE REQUEST condition 301 is met, and the lane number is identified and stored 302. If a red light (RL) condition 303 is met, then the transit time ΔT1 (from FIG. 6) is stored 310. The transit time may be used to calculate the speed of the vehicle in order to determine whether a speed violation has occurred, using conventional techniques (not shown). The transit time ΔT1 may also be used to calculate a delay time ΔT3 and a trigger time ΔT2 for taking photographs of the vehicle, as discussed below. An optional feature is the condition 306 that requires a red light grace period (e.g., 1.0 second) to expire or elapse. Using that feature, if a vehicle crosses the stop bar 0.8 second after the light turns red, then no photograph will be taken. Another optional feature is the condition 308 that requires the red light to not be near the end of the red light cycle for a photograph to betaken. This feature 308 may include measuring the time of the red light cycle of traffic signal 40, then subtracting a predetermined time period (e.g., 1.0 second) to arrive at a modified red light cycle. Accordingly, a vehicle that crosses the stop bar 42 an instant before the light turns from red to green will not be photographed, so that the system will not take a photograph of a vehicle in the intersection zone when the light is green.

After the one or more red light conditions have been met, the transit time ΔT1 is stored (see action 310) and the system enters the TRIGGER CAMERA state 312. There, a picture (also referred to as a photograph, pictorial record, or image) is taken, as indicated by TAKE PHOTO 1 (action 314) and all other pending photograph requests are canceled as indicated by CANCEL ALL REQUESTS (action 316). This picture is considered a pre-violation or identification photograph, since the purpose is to record the vehicle prior to its entrance into the intersection, preferably before it crosses the stop bar 42. The camera should be positioned in such a way that the picture also captures the traffic light itself as shown in FIGS. 1 and 2, thus recording the image of both the vehicle and the red condition of the traffic light 40 prior to the violation. If multiple photograph requests are received simultaneously, the camera system (or the control system) selects one of the lanes arbitrarily and the others are canceled. It is contemplated that simultaneous requests from different lanes could result from a car driving in two lanes and straddling two sets of sensors. After all requests are canceled, an initial delay time ΔT3 is calculated (action 318). A timer is set to correspond to the initial delay time ΔT3 (action 319). After being set, the timer begins to count down to zero at which point the time is considered to have elapsed. Preferably, the timer is set and begins to run when the vehicle is at location 502. After the timer is set and begins to run, the system then enters a CAMERA DELAY state 320, where the camera is prepared and the photograph is delayed until the vehicle is scheduled to enter the intersection zone. If a CONFIRMATION is received (condition 322) before the time on the timer (which started at ΔT3) has elapsed by reaching zero (condition 326), then a trigger time ΔT2 is calculated (event 323) and the timer is set to ΔT2 (action 324), beginning a new countdown to zero. Accordingly, the timer will initially be set either at ΔT3 or ΔT2 and the time on the timer will elapse after counting down to zero from one of those initial set times.

As discussed above, both the trigger time ΔT2 and the initial delay time ΔT3 should be transmitted to a timer, which may be part of the processor 116. When the timer is set, it begins to run or "count down." Preferably the timer is set when some initiating event (e.g., a sensed event) has occurred. Preferably, the initiating event is the passage of the rear of the vehicle over the presence sensor (e.g., when a CONFIRMATION is sent) but the initiating event may also be the passage of the front or rear wheels of the vehicle over the second position sensor 10. After the sensed event occurs, the timer is set (e.g., to ΔT2). When the time has expired (elapsed) on the timer (condition 326), the system moves to the TRIGGER CAMERA state 328. The second photograph is then triggered, which preferably occurs when the vehicle is in the intersection zone, and more preferably when the vehicle is at location 506 and the rear of the vehicle is positioned at the intersection point 44*a*. As shown in FIG. 7, the elapsed time from when the timer is set until it runs down to zero may be either the delay time ΔT3 or the trigger time ΔT2. After TAKE PHOTO 2 (event 330) all requests are canceled and the system reverts to the CAMERA IDLE state 300.

In general, the second photograph should be taken after some delay period has elapsed. The actual delay period depends on how the timer is set which may be based on either the calculated initial delay period ΔT3 or the calculated trigger time ΔT2. The camera preferably takes the second photograph based on either the calculated trigger time ΔT2 (when the vehicle is at location 506) or a default photograph using the initial delay period ΔT3 (when the vehicle is at location 508). Both the calculated trigger time ΔT2 and the initial delay period ΔT3 should be based on some multiple of the transit time ΔT1, which is preferably stored in computer memory (see FIG. 6) and which is preferably the measurement of the actual time elapsing for the vehicle to travel from one position sensor to the other and thus is dependent on the vehicle's speed. The "default"

photograph, based on the initial delay period ΔT3, is dependent on speed alone and not presence information. Referring to FIG. 8, the initial delay period ΔT3 for taking the default photograph is preferably an initial estimate of when the vehicle will enter the intersection zone 44 or when a selected part of the vehicle will hit the intersection point 44*a* (photo point). For example, the initial delay period ΔT3 could be 4 multiplied by ΔT1. For purposes of triggering the camera, the delay period preferably begins to run (and the timer is set) when the front tires of the vehicle hit the second sensor 10. After the initial delay as reflected on the timer has elapsed, a photograph is taken. Accordingly, the default picture is taken regardless of presence information provided by the presence sensor.

In contrast, a photograph based on a delay period that is the trigger time ΔT2 is based on both speed and presence information. Like the delay period ΔT3, the trigger time ΔT2 is preferably some multiple of the transit time ΔT1, but is also preferably related to the actual distance from a reference point to the intersection point. For example, the trigger time ΔT2 may be transit time multiplied by the ratio of D2:D1, i.e., the ratio of the presence sensor-to-intersection zone distance D2 (the distance from the trailing edge 25 of the presence sensor 22 to the intersection point 44*a*) to the distance D1 between the position sensors 10 and 12. Accordingly, if the transit time is 0.5 seconds, the distance D1 between the position sensors is 10 feet, and the distance D2 between the trailing edge 25 of the presence sensor 22 and the intersection point 44*a* is 20 feet, then the calculated trigger time would be 20/10 times 0.5 seconds, or 1.0 second. Also, the timer is preferably set using the trigger time ΔT2 when the rear of the vehicle has left the presence sensor. Thus, the timer is set to 1.0 second when the presence sensor indicates the vehicle has left the area over the induction loop. When 1.0 second has elapsed, a photograph is taken.

What is claimed:

1. A method of recording the image of a moving vehicle within a traffic intersection, said method comprising the steps of:

transmitting a traffic light signal to a control system, the traffic light signal indicating the phase of a traffic light located proximate the traffic intersection;

transmitting a first set of signals to the control system, said first set of signals corresponding to the speed of the vehicle;

transmitting a second set of signals to the control system, said second set of signals indicating the presence of the vehicle within a presence zone located outside the traffic intersection; and photographing the vehicle while the vehicle is within a preselected intersection zone inside the intersection, wherein the triggering of said photograph is responsive to the first and second sets of signals and is dependent on the speed of the vehicle.

2. The method according to claim 1, additionally comprising the step of photographing the vehicle while the vehicle is outside the preselected intersection zone in response to said first set of signals.

3. The method according to claim 1, wherein the transmitting of the first set of signals is responsive to the vehicle passing over a first traffic sensor and wherein the first set of signals comprises first and second position signals transmitted from the first traffic sensor.

4. The method according to claim 1, wherein the step of photographing the vehicle within the preselected intersection zone is performed after a delay period has elapsed, said delay period being formed from the first set of signals.

5. The method according to claim 1, wherein the first traffic sensor comprises first and second position sensors, said first position sensor transmitting a first position signal, said second position sensor transmitting a second position signal, and wherein said vehicle is photographed after a delay period has elapsed, said delay period being a multiple of the time elapsed between the transmission of the first and second position signals.

6. The method according to claim 1, wherein the first traffic sensor comprises first and second position sensors and wherein the step of photographing the vehicle within the preselected intersection zone is based on the measured time elapsed between the passage of the vehicle over the first position sensor and the passage of the vehicle over the second position sensor.

7. The method according to claim 1, wherein the triggering of the photograph is also dependent on the presence of the vehicle within a presence zone outside the preselected intersection zone.

8. The method according to claim 1, wherein the first traffic sensor is located a predetermined distance from the intersection and comprises two piezoelectric strips disposed in, on, or under the roadway.

9. The method according to claim 1, wherein the first traffic sensor comprises a first position sensor and a second position sensor and, wherein the step of transmitting the first set of signals to the control system comprises transmitting a first position signal to the control system responsive to the passage of the vehicle over the first position sensor and transmitting a second position signal to the control system responsive to the passage of the vehicle over the second position sensor.

10. The method according to claim 1, wherein the first traffic sensor comprises first and second position sensors and the first set of signals is used to determine whether a violation is likely to occur based on measured transit time between the first and second position sensors.

11. The method according to claim 1, wherein the first traffic sensor comprises first and second sensor strips and the first set of signals is used to trigger the photograph of the vehicle within the predetermined intersection zone using the transit time between the first and second sensor strips.

12. The method according to claim 1, wherein:

a first traffic sensor comprises first and second sensor strips;

a first signal is transmitted to the control system and a timer is activated when a vehicle passes over a first position sensor of said first traffic sensor;

a second signal is transmitted to the control system when the vehicle passes over a second position sensor of said first traffic sensor;

the control system measures the transit time between the first and second position sensors during a stop phase of a traffic light;

the transit time is compared to a predetermined value to determine whether a traffic violation is likely to occur;

a first photograph of the vehicle is taken when or shortly after the vehicle has passed over the second position sensor in a pre-violation photograph zone; and the transit time is stored for later use in triggering the camera to photograph the vehicle in the predetermined intersection zone.

13. The method according to claim 1, additionally comprising the step of determining the speed of the vehicle from the first set of signals.

14. The method according to claim 1, additionally comprising the step of photographing the vehicle while the vehicle is outside the preselected intersection zone.

15. The method according to claim 13, additionally comprising the step of recording the image on a charge-coupled device and storing the recorded image for later retrieval.

16. The method according to claim 1, additionally comprising the step of transmitting a set of signals to a camera system, said set of signals is being responsive to the traffic light signal, the first set of signals, and the second set of signals.

17. The method according to claim 1, wherein the second set of signals is responsive to the relationship of the vehicle to the preselected intersection zone.

18. The method according to claim 1, wherein the second set of signals is responsive to the presence of the vehicle within a preselected presence zone.

19. The method according to claim 1, wherein the second set of signals is transmitted to the control system in response to the presence of the vehicle over an induction loop disposed in the roadway, which is located partially or totally outside the intersection.

20. The method according to claim 1, wherein the step of photographing the vehicle comprises recording an image of the vehicle on film while the vehicle is within the preselected intersection zone.

21. The method according to claim 1, additionally wherein the step of photographing the vehicle comprises recording the image of the vehicle on a charge-coupled device while the vehicle is within the preselected intersection zone.

22. An apparatus for monitoring traffic at an intersection, said apparatus comprising: a camera, a sensor system and a control system, wherein the camera is configured to be triggered to photograph a vehicle at a preselected intersection zone within the intersection, said camera being triggered based on signals indicating the phase of a traffic light proximate the intersection and signals from the sensor system reflecting the speed of the vehicle and on signals from the sensor system reflecting an outer rear edge of the vehicle.

* * * * *